US006928781B2

(12) United States Patent
Desbois et al.

(10) Patent No.: US 6,928,781 B2
(45) Date of Patent: Aug. 16, 2005

(54) ROOF SYSTEM WITH ROWS OF SUPERIMPOSED TILES

(75) Inventors: Christophe Desbois, Authume (FR); Jean-Marie Gotti, Authume (FR)

(73) Assignee: Novitech, Champvans (FR)

( * ) Notice: Subject to any disclaimer, the term of this patent is extended or adjusted under 35 U.S.C. 154(b) by 90 days.

(21) Appl. No.: 10/296,448

(22) PCT Filed: May 25, 2001

(86) PCT No.: PCT/FR01/01618

§ 371 (c)(1),
(2), (4) Date: May 7, 2003

(87) PCT Pub. No.: WO01/90507

PCT Pub. Date: Nov. 29, 2001

(65) Prior Publication Data

US 2003/0182888 A1 Oct. 2, 2003

(30) Foreign Application Priority Data

May 24, 2000 (FR) ..... 00 06611

(51) Int. Cl.[7] ..... E04D 1/34

(52) U.S. Cl. ..... 52/551; 52/535; 52/536; 52/552

(58) Field of Search ..... 52/535, 536, 551, 52/552

(56) References Cited

U.S. PATENT DOCUMENTS

| | | | | | |
|---|---|---|---|---|---|
| 4,096,679 | A | * | 6/1978 | Naz | 52/551 |
| 4,854,102 | A | * | 8/1989 | Feil et al. | 52/535 |
| 4,890,432 | A | * | 1/1990 | Shepherd | 52/535 |
| 5,642,596 | A | * | 7/1997 | Waddington | 52/551 |

FOREIGN PATENT DOCUMENTS

| | | |
|---|---|---|
| EP | 0 074 011 | 3/1983 |
| GB | 2 261 230 | 5/1993 |

* cited by examiner

*Primary Examiner*—Anthony D Barfield
(74) *Attorney, Agent, or Firm*—Young & Thompson

(57) ABSTRACT

A roof system with rows of superimposed tiles (1) comprising rafters (4) and parallel horizontal shingles (2) fixed to the rafters, each shingle (2) consisting of a shaped section having an upper planar support surface (2*c*) partly present on a catching wing (2*b*) projecting upwards, in the direction of the slope of the roof, whereon is engaged, further down, at least a hook (1*a*), open downwards, formed on the low marginal part of the bottom surface (1*b*) of each tile of an upper row. The invention is characterized in that it comprises a rail (3) fixed, in the direction of the slope, on the upper surface of each rafter (4), said rail (3) being provided, on its top surface, with elements (3*a*, 3*b*) maintaining in place each shingle (2).

10 Claims, 2 Drawing Sheets

3
1
4
2
1a
2

1
1a
1b
2b
2c
2e
3
1c
1d
2
2a
1
3a
2f
2d
3b
2g

1

1a

ROOF SYSTEM WITH ROWS OF SUPERIMPOSED TILES

The present invention relates to a roof system with rows of superimposed tiles for a bearing structure.

Tiled roofs generally comprise, in order to support these tiles, horizontal shingles fixed at a predetermined distance from one another depending on the length of each tile, these shingles in turn being fixed on the upper surfaces of the rafters of a framework. In a roof system described in Patent GB-A-2 260 230, each shingle is constituted by a hollow shaped section, of rectangular cross-section, of which the upper surface is extended upwardly, in the direction of the slope of the roof, by a coplanar wing. This wing serves to catch the tiles of which each is provided, on the lower down marginal part of its lower surface, with hooks intended to engage from top to bottom on the wing of the section, in order to ensure positioning of the tile and its maintenance in place.

The present invention concerns improvements relating to the afore-mentioned roof system, with a view to simplifying its implementation and to substantially reducing its cost price.

To that end, this roof system with rows of superimposed tiles for a bearing structure comprising rafters inclined on the horizontal and parallel horizontal shingles fixed to the rafters, at a distance from one another depending on the length of the tiles, each shingle being constituted by a shaped section having an upper planar support surface partly present on a catching wing projecting upwards, in the direction of the slope of the roof, on which is downwardly engaged at least one downwardly open hook formed on the lower down marginal part of the lower surface of each tile of a higher up row, is noteworthy in that it comprises a rail fixed, in the direction of the slope, on the upper surface of each rafter, this rail being provided, on its upper surface, with elements maintaining each shingle in place.

A form of embodiment of the present invention will be described hereinafter by way of non-limiting example, with reference to the accompanying drawings, in which.

Figure 1:
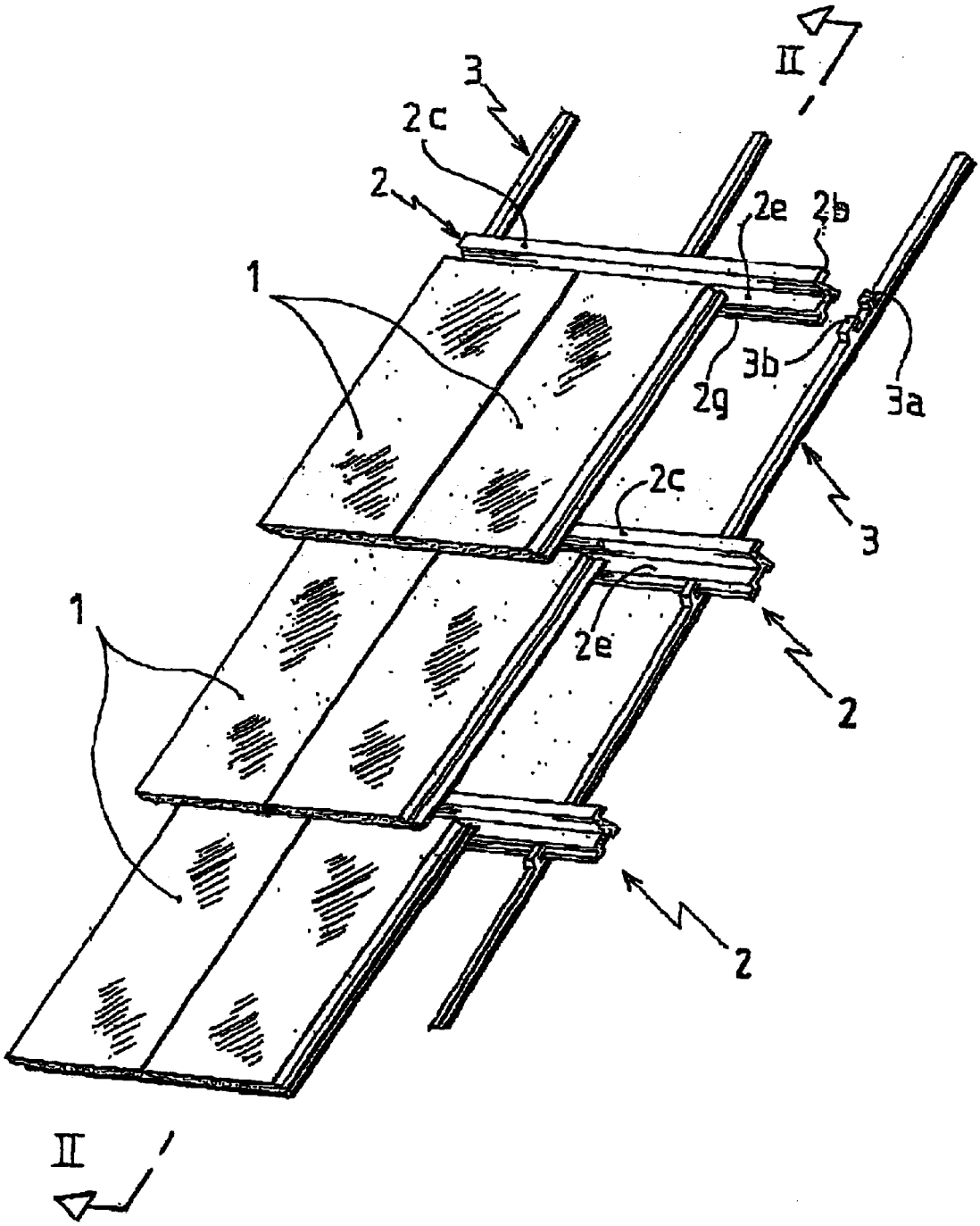
FIG. 1 is a partial view in perspective of a roof system with rows of superimposed tiles according to the invention.
Figure 2:
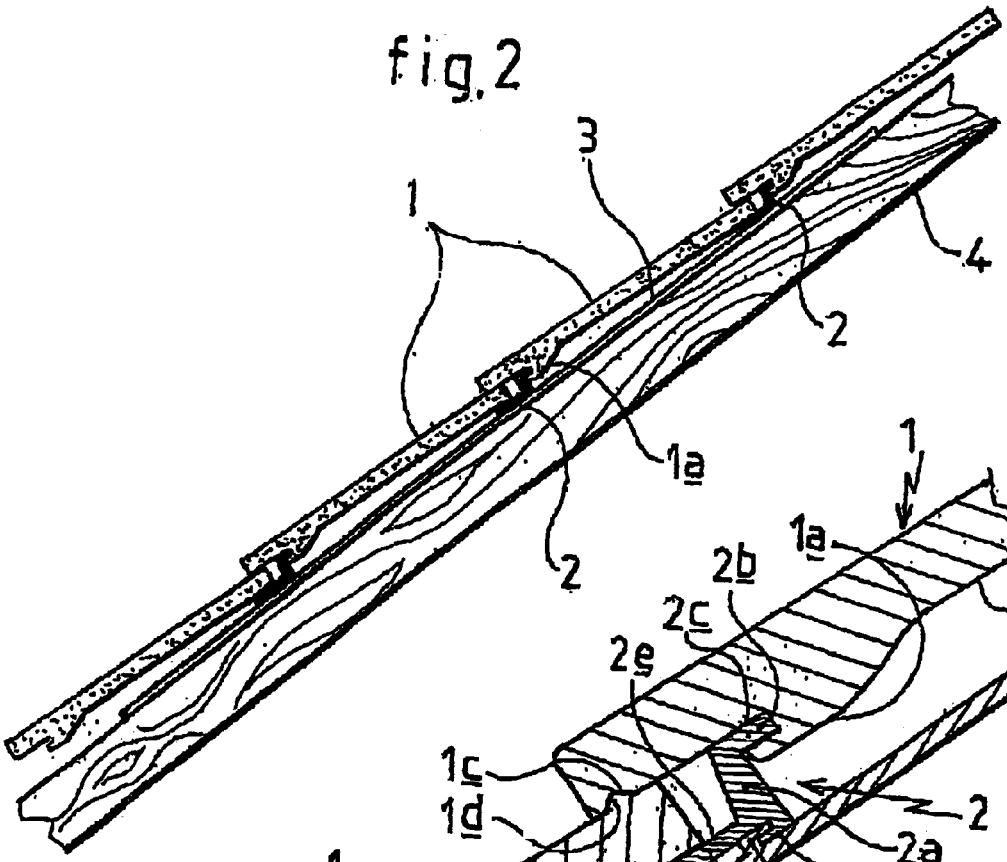
FIG. 2 is a view in vertical and transverse section made along line II—II of FIG. 1.

The roof system according to the invention comprises rows of tiles 1 which are maintained in place by parallel horizontal shingles 2. These horizontal shingles 2 are fixed, at a constant distance from one another, on parallel rails 3 themselves fixed, for example by means of screws, on the upper surfaces of rafters 4 of a framework (FIG. 2). The tiles 1, of rectangular shape, are joined to one another, by their large sides, in the horizontal direction and they overlap one another slightly, in conventional manner, by their higher up and lower down marginal parts. In the following description, the expressions "higher up" and "lower down" must be considered as referring to the slope of the roof, while the expressions "lower" and "upper" must be considered as referring to parts of the tiles 1, shingles 2 and rails 3 in the positions that they occupy once placed in position.

Figure 3:
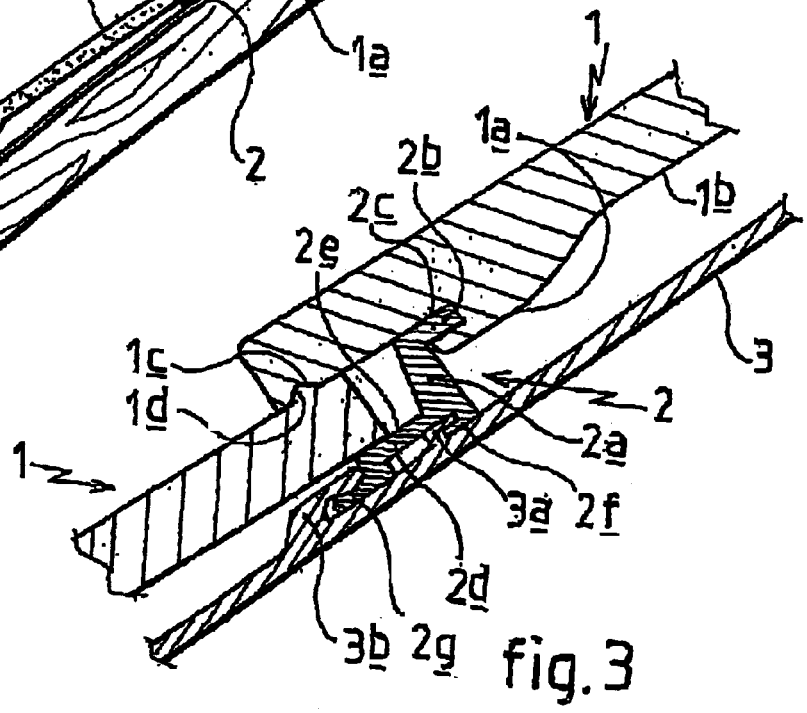
FIG. 3 is a view in vertical and transverse section, on a larger scale, illustrating the superposition of two tiles and their assembly on a shingle.
Figure 4:
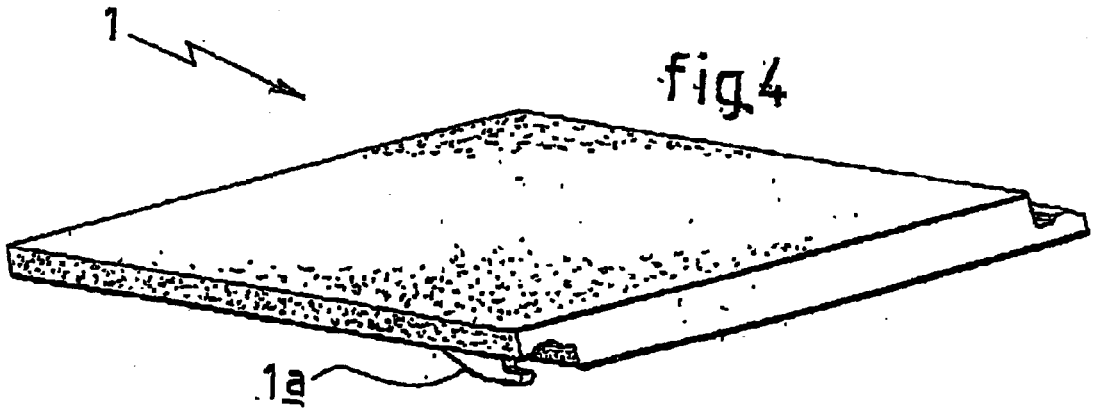
FIG. 4 is a view in perspective of a tile used in the roof system.

Each shingle 2 is constituted by a shaped section made of metal or plastics material, in particular of light alloy or polyvinylchloride. Each shingle 2 comprises a web 2*a* which extends substantially perpendicularly to the rail 3 on which the shingle 2 is fixed and which is extended, at its upper end, by a catching wing 2*b* extending upwardly, in the direction of the slope. The upper end of the web 2*a* and the upper surface of the catching wing 2*b* which are coplanar jointly define a planar upper support surface 2*c*. As is illustrated more particularly in FIG. 3, the upper wing 2*b* engages in at least one downwardly open hook 1*a* which is formed, in the lower down part of the tile 1, on the lower face 1*b* of this tile. The upper catching wing 2*b* serves as support for the lower down marginal part of a tile 1 of a higher up row which is maintained in place by its hook or hooks 1*a*.

At its lower end, the web 2*a* of the shingle 2 joins a base 2*d* which extends substantially parallel to the rail 3 and which is defined, in its upper part, by a second planar support surface 2*e* which extends downwardly, is located at a level lower than that of the first support surface 2*c* and is parallel to the latter. The second support surface 2*e* serves as support for the higher up marginal part of a tile 1 of the lower down row located immediately below the tile 1 of the higher up row. The distance between the planes of the first support surface 2*c* and the second support surface 2*e* is substantially equal to the thickness of each tile 1 so that the lower down marginal part of the tile 1 of the higher up row is substantially in contact, by its lower surface, with the upper surface of the higher up marginal part of the tile 1 of the lower down row, this corresponding to the usual overlap of two superimposed tiles at that spot. It should be noted that, to allow the regular superposition of the tiles 1, the support surfaces 2*c* and 2*e* are slightly inclined upwardly in the direction of the rails 3, so as to give this same inclination to the tiles 1 which are all parallel to one another.

The tightness between the tiles of the higher up and lower down rows may be reinforced at the places where they are superimposed, by providing a horizontal groove (or rib) 1*c* parallel to the lower down small side of the tile 1 of the higher up row and a rib (or groove) 1*d* on the upper surface of the higher up marginal part of the tile 1 of the lower down row. The positions of the groove and of the rib of each tile 1 are such that they fit in one another when two tiles, once placed in position, are superimposed.

Each shingle 2 may be fixed to the rails 3 by any appropriate means. According to a characteristic of the invention, each shingle 2 and each rail 3 are preferably made so as to present respective coupling members which make it possible to fix a shingle 2 to a rail 3 by a simple movement of slide of the shingle 2, from top to bottom, on the rails 3. To that end, each rail 3 presents, on its upper surface, two hooks distant from each other in the direction of the slope, namely an upstream hook 3a and a downstream hook 3*b*, i.e. located lower down than the preceding one, these two hooks being upwardly open. For its part, the base 2*d* of the shingle 2 presents, on its lower surface, an upstream catching element 2*f*, whose shape is complementary of that of the upstream hook 3*a* of the rail 3, and a downstream catching element 2*g* whose shape is complementary of that of the downstream hook 3*b* of the rail 3. The pair of hooks 3*a*, 3*b* of the rail 3 and the pair of catching elements 2*f*, 2*g* may comprise means ensuring clipping of the shingle 2 on the rail 3. In the non-limiting form of embodiment shown in FIG. 3, it is the pair of downstream catching elements 2*g*, 3*g* which ensures such clipping, the downstream hook 3*b* of the rail 3 presenting a boss engaging in a hollow provided in the downstream catching element 2*g* of the shingle 2.

It is seen from the foregoing description that the roof system according to the invention makes it possible to position the tiles and maintain them in place in simple and rapid manner, ensuring a perfect tightness. Due to the superposition, over an appropriate length, of the tiles in the direction of the slope, the lower down part of a higher up tile ensures perfect hold of the higher up part of a lower down tile. The shingles 2 are positioned very easily and very rapidly by causing them to slide downwardly over the upper faces of the rails 3 until their coupling with these rails is obtained by means of the cooperation of the hooks 2*f*, 3*a* and 2*g*, 3*b*.

What is claimed is:

1. Roof system with rows of superimposed tiles (1) for a bearing structure comprising rafters (4) inclined to the horizontal and parallel shingles (2) fixed to the rafters, at a distance from one another depending on the length of the tiles, each shingle (2) being constituted by a shaped section having an upper planar support surface (2*c*) on a catching wing (2*b*) projecting upwards, in the direction of the slope of the roof, on which is downwardly engaged at least one downwardly open hook (1*a*) formed on the lower down marginal part of the lower surface (1*b*) of each tile of a higher up row, characterized in that it comprises a rail (3) fixed, in the direction of the slope, on the upper surface of each rafter (4), this rail (3) being provided on its upper surface, with elements (3*a*, 3*b*) maintaining each shingle (2) in place.

2. Roof system according to claim 1, characterized in that the elements of each rail (3) maintaining the shingles (2) in place are constituted by a pair of hooks (3*a*, 3*b*) distant from each other in the direction of the slope, open upwardly, and cooperating with catching elements (2*f*, 2*g*) provided in the lower part of the shaped section of each shingle (2) and fitting in the hooks (3*a*, 3*b*) by a downward sliding movement of each shingle (2) over the rails (3).

3. Roof system according to claim 2, characterized in that the rail (3) and the catching elements (2*f*, 2*g*) of each shingle (2) comprise means ensuring clipping of the shingle (2) on the rail (3).

4. Roof system according to claim 3, characterized in that each shaped section constituting a shingle (2) comprises a web (2*a*) substantially perpendicular to the rail (3), joining the upper catching wing (2*b*) to a base (2*d*) of the shaped section which extends downwardly and is substantially parallel to the rail (3), this base (2*d*) comprising, on its lower face, the catching elements (2*f*, 2*g*) cooperating with the hooks (3*a*, 3*b*) of the rail (3).

5. Roof system according to claim 2, characterized in that each shaped section constituting a shingle (2) comprises a web (2*a*) substantially perpendicular to the rail (3), joining the upper catching wing (2*b*) to a base (2*d*) of the shaped section which extends downwardly and is substantially parallel to the rail (3), this base (2*d*) comprising, on its lower face, the catching elements (2*f*, 2*g*) cooperating with the hooks (3*a*, 3*b*) of the rail (3).

6. Roof system according to claim 5, characterized in that the first and second parallel support surfaces (2*c*, 2*e*) are slightly inclined from bottom to top in the direction of the rails (3).

7. Roof system according to claim 1, characterized in that the shaped section of each shingle (2) presents downwardly, in the direction of the slope of the roof, a second planar support surface (2*e*), located at a level lower than that of the upper support surface (2) for the higher up marginal part of each tile (1) belonging to the lower down row, the first and second support surfaces (2*c*, 2*e*) are parallel to each other and the distance between their planes is substantially equal to the thickness of each tile (1).

8. Roof system according to claim 7, characterized in that the first and second parallel support surfaces (2*c*, 2*e*) are slightly inclined from bottom to top in the direction of the rails (3).

9. Roof system according to claim 7, characterized in that each shaped section constituting a shingle (2) comprises a web (2*a*) substantially perpendicular to the rail (3), joining the upper catching wing (2*b*) to a base (2*d*) of the shaped section which extends downwardly and is substantially parallel to the rail (3), this base (2*d*) comprising, on its lower face, the catching elements (2*f*, 2*g*) cooperating with the hooks (3*a*, 3*b*) of the rail (3).

10. Roof system according to claim 1, characterized in that each tile (1) presents, on the lower down marginal part of its lower face (1*b*), a horizontal groove (or rib) (1*c*), and on the higher up marginal part of its upper face, a horizontal rib (or groove) (1*d*), the positions of the rib and of the groove being such that they fit in each other when two tiles (1), once in place, are superimposed.

* * * * *